United States Patent [19]

Plancon et al.

[11] 4,357,693

[45] Nov. 2, 1982

[54] ELECTRONIC HOUR TIMESETTING DEVICE FOR ELECTRONIC ANALOG TIMEPIECE

[75] Inventors: Michel Plancon, Besancon; Jean-Pierre Migeon, Audeux; Paul Grand Chavin, Besancon, all of France

[73] Assignee: Timex Corporation, Waterbury, Conn.

[21] Appl. No.: 161,464

[22] Filed: Jun. 20, 1980

[51] Int. Cl.[3] ..... G04B 27/00

[52] U.S. Cl. ..... 368/187

[58] Field of Search ..... 368/69, 70, 76, 80, 368/185, 187, 188, 89, 155, 156, 157, 160

[56] References Cited

U.S. PATENT DOCUMENTS

| | | | |
|---|---|---|---|
| 3,928,959 | 12/1975 | Maito | 368/188 |
| 4,030,283 | 6/1977 | Sauthier et al. | 368/188 |
| 4,092,822 | 6/1978 | Droz et al. | 368/187 |
| 4,112,671 | 9/1978 | Kato et al. | 368/188 |
| 4,143,509 | 3/1979 | Weibel | 368/185 |
| 4,173,863 | 11/1979 | Motoki et al. | 368/185 |
| 4,192,134 | 3/1980 | Yoshida | 368/80 |
| 4,196,578 | 4/1980 | Besson | 368/188 |
| 4,199,932 | 4/1980 | Bernet | 368/80 |
| 4,275,463 | 6/1981 | Ishida | 368/187 |

*Primary Examiner*—Vit W. Miska

*Attorney, Agent, or Firm*—William C. Crutcher; Joseph A. Biela

[57] ABSTRACT

An electronic analog timepiece with hour and minute hand driven by a stepping motor in accordance with low frequency timekeeping signals supplied by a high frequency quartz time reference. The electronic time-setting control circuit is controlled by a single manual push-button switch. The time is adjusted for correction, daylight saving or time zone change at slow, fast and accelerated rate in the clockwise and counterclockwise directions. Both an automatic single hour time correction with automatic restart, and a manual restart option are incorporated.

12 Claims, 7 Drawing Figures

ELECTRONIC HOUR TIMESETTING DEVICE FOR ELECTRONIC ANALOG TIMEPIECE

BACKGROUND OF THE INVENTION

This invention relates generally to electronic timepieces, particularly quartz analog wristwatches. As is well known in the art, these include a quartz controlled oscillator supplying high frequency time reference signals to a countdown divider chain, which ultimately provides low frequency time keeping signals of great accuracy. These timekeeping signals actuate a drive circuit providing drive pulses of a selected wave shape to drive a stepping motor which turns hour, minute and sometimes second hands through a gear train. These drive pulses may be repetitive wave shapes of the same polarity for driving stepping motors of the type shown in U.S. Pat. Nos. 3,818,690 issued to Schwarzschild or 4,070,279 Oudet et al issued Mar. 14, 1978. Alternately, the stepping motor may be of the type receiving pulses of alternating polarity as described in U.S. Pat. No. 4,112,671 Kato et al issued Sept. 12, 1978.

It is further known that time correction of such a timekeeping circuit may be effected by supplying sources of different wave shapes or polarities to reverse the direction of the stepping motor so as to drive the hands counterclockwise, and that the movement of the hands can be speeded up and driven at various speeds in both the forward and reverse directions. Examples of the foregoing electronic timesetting circuits are shown in German Pat. No. 2,025,710; U.S. Pat. No. 4,173,863 Motoki et al issued Nov. 13, 1979; U.K. pat. No. 1,557,145 (Daini Seikosha); and U.S. Pat. No. 4,030,283 Sauthier et al issued June 21, 1977.

It is also known to use a single pushbutton switch for controlling various timesetting modes, this being illustrated in the assignee's U.S. Pat. No. 3,953,964-Suppa et al issued May 4, 1976 for a digital electronic watch, and the aforesaid U.S. Patents to Sauthier et al and to Motoki et al. An arrangement using a single pushbutton to achieve alternating forward and backward hand movement for time correction is disclosed in U.S. Pat. No. 4,192,134 issued Mar. 11, 1980 to Yoshida.

One problem associated with setting a quartz analog stepping motor watch is that, if the watch has been previously accurately set in accordance with a time standard signal, and it is desired to change the hour hand reading by exact increments of one hour for daylight saving change or time zone change, without disturbing the watch timekeeping, prior art devices do not adequately supply this defficiency.

The aforesaid U.S. Pat. No. 4,173,863 to Motoki provides for time correction of one hour but the watch must be reset by advancing the hands at a slow rate after this.

Another problem in the prior art is that it is sometimes desired to move the hands slowly in order to position them accurately for a manual restart from a time standard signal. However, if it is necessary to move the hands a great distance, this slow motion is tedious and time consuming. Therefore, it would be desirable to have an accelerated forward speed as well as other forward and reverse speeds effectuated, however, through a single pushbutton control.

Accordingly, one object of the present invention is to provide an improved electronic timesetting device for an electronic analog timepiece which automatically corrects the time in exact one hour increments with a single pushbutton control without affecting timekeeping.

Another object of the invention is to provide, in such a timepiece, an improved electronic timesetting circuit, having both slow and fast setting speeds, both forward and reverse with manual restart.

DRAWINGS

The invention both as to organization and method of practice, together with further objects and advantages thereof will best be understood by reference to the following specification, taken in consideration in the accompanying drawings in which:

FIG. 1 is a simplified schematic diagram of the main components of a quartz analog electronic timepiece, FIG. 2 is a plan view of a quartz analog wristwatch utilizing the invention, FIG. 3, 4 and 5 are diagrams illustrating forward and reverse time correction of the minute hand, FIG. 6 is block diagram showing the multiple time correction modes available in the preferred embodiment of the invention, and FIG. 7 is a logic diagram illustrating the control circuit.

SUMMARY OF THE INVENTION

Briefly stated, the invention is practiced by providing a special electronic control circuit in an electronic analog stepping motor timepiece of the type having a time standard providing periodic high frequency signals, a frequency divider providing periodic low frequency signals, and a plurality of trains of periodic intermediate frequency signals, a manual time correcting switch, a reversible stepping motor adapted to drive the hands of a timepiece in response to forward and reversing pulse wave shapes, and a drive circuit connected to supply the wave shapes to the stepping motor. The control circuit is responsive to the low frequency and the intermediate frequency signals from the divider and, in accordance with the operation of the manual switch, corrects the time in multiple modes in various forward and reverse speeds with automatic or manual restart.

In the preferred embodiment, forward and reverse correction in exact one hour increments with automatic restart is provided, with the proper compensation for the time used in making the correction in either direction. Slow and fast speeds in forward and reverse, and accelerated forward speed with manual restart are provided. Automatic switching between slow and fast speed after a preselected number of slow pulses, and automatic restart after a preselected number of fast pulses are provided by special counters incorporated into the control circuit.

DESCRIPTION OF THE PREFERRED EMBODIMENT

Figure 1:
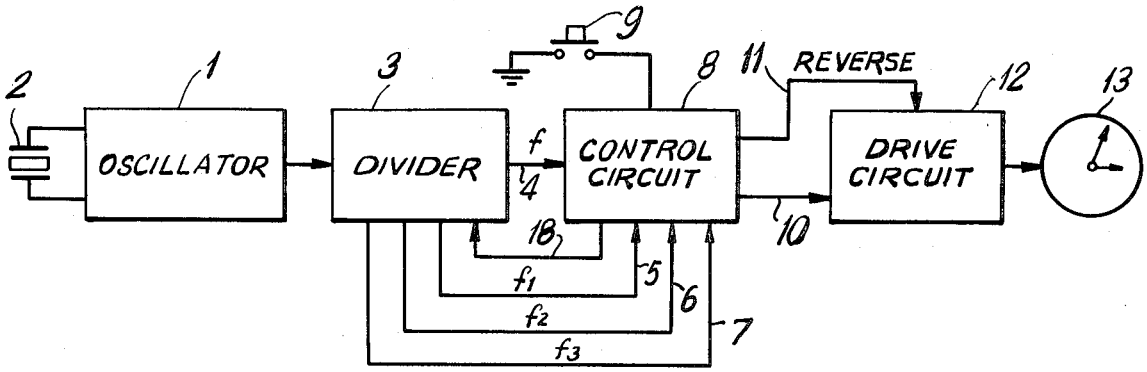

Referring to FIG. 1 of the drawings, a time standard source of high frequency signals is provided by means of oscillator 1 controlled by a quartz crystal 2 supplying a 32.768 kHz signal to a divider count down chain 3. The divider 3 is a series of conventional flip-flop stages each dividing the frequency by a factor of two and ultimately providing a low frequency signal f at the output on lead 4. Divider 3 is also arranged to provide a plurality of trains of intermediate frequency signals of progressively higher frequencies f1, f2 and f3 on leads 5, 6, 7 respectively. These are supplied, along with the low frequency signals f to a time correcting control circuit 8. A manual time correcting pushbutton switch 9 is also connected to the control circuit. Control circuit 8 supplies a series of stepping pulses at normal, slow, fast or accelerated frequency over lead 10 and a reversing signal over lead 11 to a conventional stepping motor drive circuit 12. The drive circuit 12 provides pulses of a suitable wave shape for forward or reverse operation of a conventional reversible stepping motor 13. The latter drives the hands of the timepiece through a conventional gear train.

Figure 2:
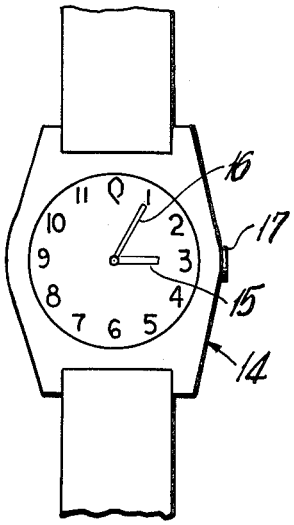

FIG. 2 of the drawing illustrates a quartz analog wristwatch 14 with hour and minute hands 15, 16 and a pushbutton 17 in place of the conventional watch crown. In order to prevent inadvertent actuation, pushbutton 17 preferably has a low profile or may be fully recessed, if desired, with an indentation for actuation by a pointed instrument such as a ballpoint pen.

Figure 7:
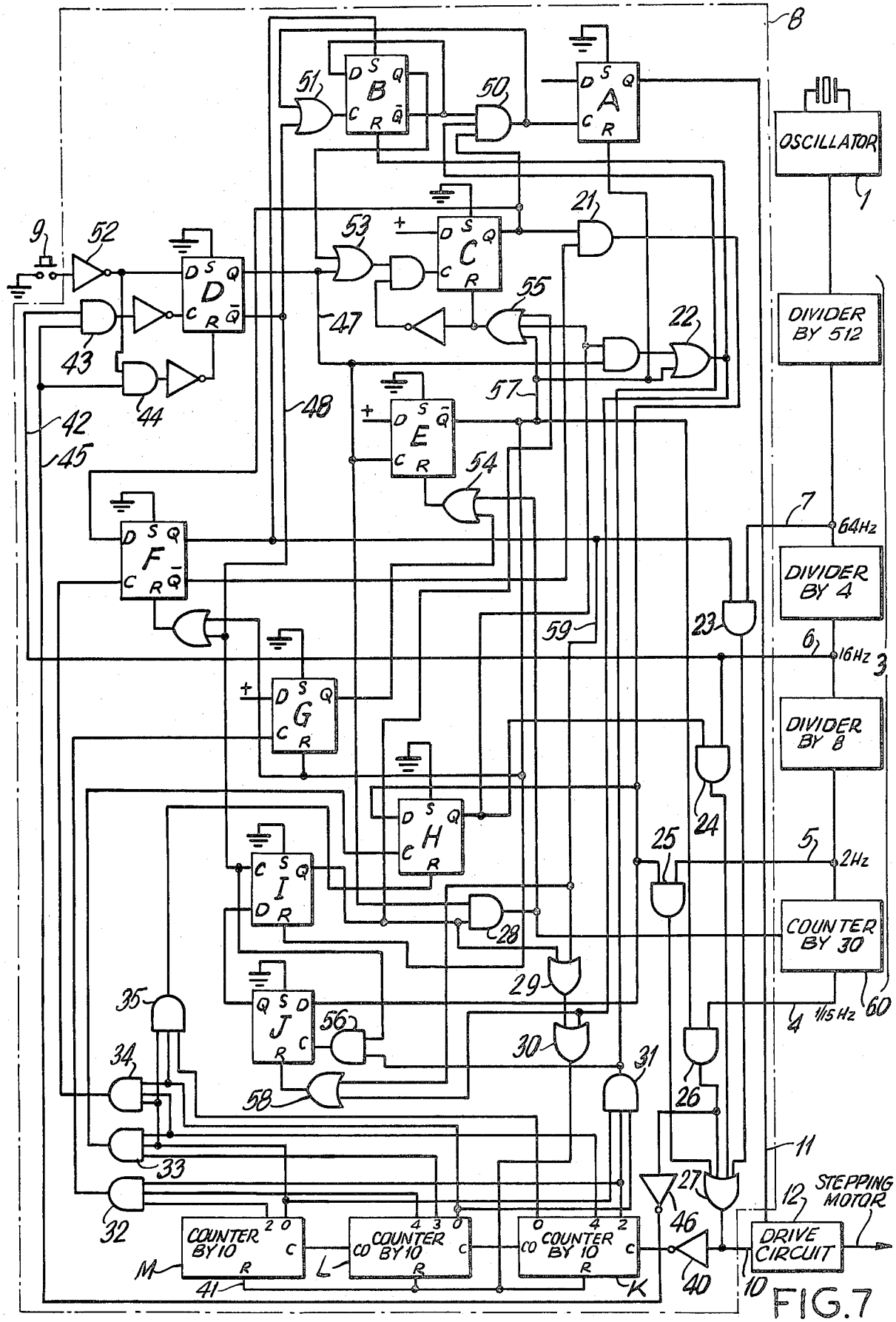

The detailed logic diagram for the control circuit 8 is shown in FIG. 7 enclosed in dot-dash lines. Inputs to the control circuit from divider 3 comprise a 1/15 Hz signal on lead 4 comprising the low frequency signal f. Intermediate frequency signals $f_1$, $f_2$ and $f_3$ are supplied by a first intermediate frequency signal of 2 Hz on lead 5, a second intermediate frequency signal of 16 Hz on lead 6, and a third intermediate frequency signal of 64 Hz on lead 7.

The output signals from control circuit 8 to the drive circuit 12 comprise a stepping motor pulse rate signal supplied on lead 10 and a reversing signal on lead 11. The pushbutton 9 operates and selectes the "program" in which the control circuit functions.

CONTROL CIRCUIT GENERAL DESCRIPTION

The logic diagram of FIG. 7 illustrates the preferred embodiment of a control circuit in terms of conventional logic elements, including AND and OR gates, D type flip-flops, and decade counters which can be implemented with any desired type of logic system. Preferably the logic of the control circuit 8 is carried out on an integrated circuit chip, along with appropriate circuit elements of oscillator 1, divider 3 and drive circuit 12, in a manner which is well known to those skilled in the art. Various "programs" of time correcting sequences are initiated in control circuit 8 by means of the single pushbutton 9, depending upon the time correcting program desired (see Table 3). Four different stepping motor pulse rate signals are provided by the frequency divider and according to the selected program the logic switches of the control circuit select the proper pulse frequency and counters count the number of pulses to carry out the program. In accordance with the foregoing elements, slow, fast, accelerated pulse trains for either forward or reverse hand correcting movement may be provided to the stepping motor in lieu of the normal (or low frequency) pulse signals.

The major logic elements comprise flip-flops A through J, counters L through M and gates 21 through 35. The functions of the flip-flops, counters and gates will be explained in detail, but are conveniently summarized in following Tables 1 and 2.

TABLE 1

| F/F No. | FUNCTION | TRIGGERED BY | RESET BY | PROGRAM |
|---|---|---|---|---|
| A | Reverse stepping motor. Q = cw Q = ccw | Gate 31, Flip-flop B, Flip-Flop C | Vo speed (Flip-flop E) | 2,5,6 |
| B | Test of 2 pushes in t < 1 s (ccw mode). Return to V1 speed if one push during V2 speed. | Neg. transition of push or by 2nd counter impulse if in ccw | Vo speed or 1 push during V2 speed | 1,2,3,4 5,6,7. |
| C | V1 speed, (exept during during V3 speed. | End of Vo speed, or by 1 push during V2 speed. | V2 speed or by Vo speed or by 1 push during V1 speed. | 1,2,3,4, 5,6,7. |
| D | Indicating closure of pushbutton when no Vo speed pulse | Neg. transition of 16 Hz if no Vo speed pulse when pushbutton pushed. | Pushbutton released or Vo speed pulse when P.B. pushed. | 1,2,3,4, 5,6,7. |
| E | Vo speed (on Q output) | Pos. transition of push. | End of time zone change or by 1 push when motor is switched off (for starting or time signal. | 1,2,3,4, 5,6,7. |
| F | V3 speed | 4th counter impulse if cw at V1 speed (t > 3s). | Vo speed or push button released. | 7 |
| G | End of time zone change | 242nd counter impulse. | Vo speed | 1,2 |
| H | V2 speed | 34th counter impulse. | Imp. O (counters reset). | 1,2,4,6 |
| I | Motor switched off. | Neg. transition of push during V1 speed. | Vo speed | 3,5 |
| J | Confirmation of V1 speed after 1s. | 2nd counter impulse if pushbutton released. | V3 speed or by Vo speed or by 1 push during V2 speed. | 1,2,3,4, 5,6 |

TABLE 2

| GATE NO. | FUNCTION | PROGRAM NO. |
|---|---|---|
| AND 21 | V1 speed control. | 1,2,3,4,5,6,7, |
| OR 22 | Vo speed control, or 1 push during V2 speed. | 1,2,3,4,5,6 |
| AND 23 | V3 speed (64 Hz) | 7 |
| AND 24 | V2 speed (16 Hz) | 1,2,3,4,5,6,7 |
| AND 25 | V1 speed (2 Hz) | 1,2,3,4,5,6,7 |
| AND 26 | Vo speed (1/15 Hz) | 1,2,3,5 |
| AND 27 | Speed Selection | 1,2,3,4,5,6,7 |
| AND 28 | Counter by 30 reset when motor switched off. | 3,5, |
| AND 29 | Motor Switched off or V3 speed. | 3,5,7 |
| AND 30 | Counters K,L,M Reset when Motor switched off or V3 speed or Vo speed or 1 push during V2 speed. | 1,2,3,6,5,6,7 |
| AND 31 | Decoding of pulse 2 (after 1s) | 1,2,3,6,5,6,7 |
| AND 32 | Decoding of pulse 242 (after 30 s) | 1,2, |
| AND 33 | Decoding of pulse 34 (after 17 s at V1 speed). | 1,2,6,6,7 |
| AND 34 | Decoding of pulse 4. | 1,2,3,4,5,6,7 |
| AND 35 | Decoding of counters at 0 | 3,5 |

PROGRAM AND SPEED SELECTION

The selected program and speed of the stepping motor is controlled by logic switching means comprising flip-flops A-J in conjunction with gates 21–35. Flip-flop A has an output connected to lead 11 which reverses the stepping motor. Flip-flop A has an input connected to one of the outputs of flip-flop B through a gate designated by reference number 50, which also has inputs from flip-flop C and gate 31. Flip-flop B has an input connected to an output of flip-flop D through an OR gate 51. Flip-flop D has an input connected to the pushbutton 9 via an inverter 52, so that the outputs of flip-flop D indicate the position of the pushbutton. The logic is arranged so that a logic high signal appears on lead 47 when the pushbutton is pressed and a logic high signal on lead 48 when the pushbutton is released. The Q outputs of flip-flops B and D are connected to an input of flip-flop C through an OR gate 53.

Flip-flop E, which controls the normal watch running speed has its input connected to lead 47. Flip-flop F, which controls the accelerated stepping motor speed V3 has its clock input connected to the output of gate 34 measuring the fourth counter impulse and its D input connected to the Q output of flip-flop C.

Flip-flop G, which serves to measure the end of a one hour time zone change has a clock input connected to the output of gate 32 measuring the 242 second counter pulse and has its output connected to the reset terminal of flip-flop E via an OR gate 54. Flip-flop H which controls the transition between slow and fast speed setting, has its clock input connected to gate 33 measuring the 34th counter inpulse and an output connected to the reset of flip-flop C via an OR gate 55.

Flip-flop I has an input connected to the lead 48 so as to receive an inpulse when a pushbutton is released, and flip-flop J is also connected to lead 48 via an AND gate 56. An output of flip-flop J is connected to an input of flip-flop I.

The rate of the stepping motor is determined by the frequency of pulses gated by OR gate 27 having four inputs. The inputs are furnished by the outputs of the AND gates 23, 24, 25 and 26. AND gate 23 has one input connected to lead 7 from the frequency divider and the other input connected to flip-flop F. AND gate 24 has one input connected to lead 6 and the other input connected to flip-flop H. AND gate 25 has one input connected to lead 5 from the frequency divider and the other input connected to the output of gate 21. AND gate 26 has one input connected to lead 4 and the other output connected to flip-flop E. The gates 23, 24, 25, 26 and 27 comprise first gating means furnishing normal, slow, fast and accelerated stepping pulses to the drive circuit 12. The gates 31, 32, 33, 34 and 35 comprise second gating means connected to selected counter outputs.

Certain resetting functions are provided by gates connected to the output of flip-flop E on a lead 57, which is connected to the input of OR gate 55, the reset terminal of flip-flop A and to the input of OR gate 22. The output of OR gate 22 is connected to the reset terminal of flip-flop B and to the reset terminal of flip-flop J via OR gate 58.

Another resetting of the counters K, L and M accomplished via the output of OR gate 30 having as one input OR gate 29 and the other input OR gate 22. OR gate 29, in turn, has one input connected to flip-flop I and the other input connected to a lead 59 from flip-flop F.

The final counter of the frequency divider is designated by reference numeral 60. This counter has a reset terminal connected to the output of an AND gate 28 which has one input connected to flip-flop I, the other input connected to lead 47.

The flip-flops and gates of control circuit 8 comprise logic switching means arranged to carryout the various time correction programs set forth in Table 3. The logic switching means also determine which program is activated by means of flip-flop devices actuated both by the position of pushbutton 9 and timing counts from the counters, as well as various logic conditions supplied by other gates and flip-flops. Reference to tables 1 and 2 will supply the necessary understanding of the functions of the various elements in the logic switching circuits.

PULSE COUNTERS

Decade counters K, L, and M are connected in series. The input to counter K is supplied by an inverter 40 connected to the output of OR 27. The decade counters are resettable by signals on a lead 41 and having outputs connected as noted to AND gates 31, 32, 33, 34, 35. Assuming the counters are all reset, they count the number of pulses received from inverter 40 and provide an output on the number of pulses indicated in parenthesis next to the respective AND gates 31–35. In other words, gate 33 decodes an input count of 34 pulses supplied by the output values "0", "3" and "4" from counters, M, L, K respectively. The number of pulses counted is independent of the frequency of the pulses received at the input of counter K. Therefore the pulse counts are at the low frequency f or any of the intermediate frequencies f1, f2, f3. These serve to provide time delays and to count a preselected number of pulses at different time setting speeds.

PUSHBUTTON CONTROL

Pushbutton 9 is connected to the input of the flip-flop D which is clocked by negative transition of the 16 Hz signal on lead 42 when pushbutton 9 is pressed, provided that AND gate 43 is enabled. The pushbutton also resets the flip-flop D when the pushbutton is released, provided that AND gate 44 is enabled. Gates 43 and 44 are enabled by a signal on lead 45 connected to the output of normal speed pulse AND gate 21 via inverter 46. Thus, there is a logic 1 signal from the $\overline{Q}$ output of D connected to lead 47 when the pushbutton is pressed, and a logic 1 signal at the Q output of D connected to lead 48 when the pushbutton is released. One push causes output from D and C and, provided that gate 21 is enabled by F, speed V1 is commenced by gate 25. Release of the pushbutton provides an output from B to gate 50; a second push causes output from C to gate 50 and if this occurs within one second, gate 50 is enabled by a pulse from gate 31 (2 pulses to counter K). Flip-flop A will reverse the motor and commence counter-clockwise rotation.

Holding the pushbutton down more than three seconds initiates a different program. One push causes flip-flop C to provide an output to flip-flop F. The fourth impulse (gate 34) then switches F which enables gate 23 and causes the motor to step at an accelerated speed of 64 Hz pulses. Release of the pushbutton resets F and enables gate 21 to recommence slow speed V1. Another push during speed V1 followed by release of the button causes flip-flop I to stop in the stepping motor. Another push resets E to resume normal speed and also enables gate 28 to reset counter 60.

OPERATION

Figure 3:
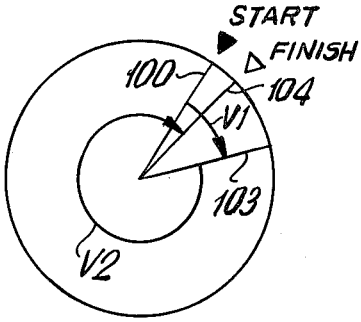
Figure 4:
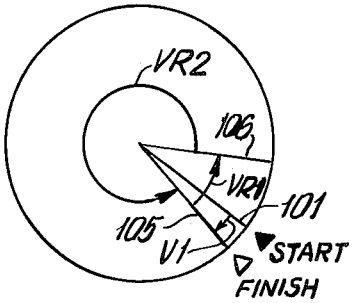
Figure 5:
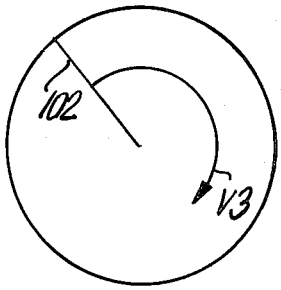

Referring to FIGS. 3, 4 and 5 of the drawing, diagrams are illustrated of the speed movement of the minute hand from its starting position designated as 100, 101, 102 in FIGS. 3, 4 and 5 respectively. Prior to correction, the minute hand is moving at speed V0. The starting position may be in any location at the time when correction is commenced, as directed. In one forward setting mode, (FIG. 3) the minute hand advances clockwise at a speed V1 for a preselected number of pulses (determined by the counters K, L and M) until it reaches a position 103 relative to the initial position 100. Thereafter it advances at a fast time correcting rate V2 until it reaches a final position 104, which is just enough beyond the starting position 100 to compensate for the time it has taken to advance the hands by an increment of one hour. Therefore, in this case, in order for the timesetting of the minutes not to be disturbed, the number of pulses selected is 242–240 for the one hour advance, and 2 pulses more to advance the time by 30 seconds for the time to carry out the correction as follows:

| | | | |
|---|---|---|---|
| 34 pulses | at V1 requires | 17 seconds | |
| 208 pulses | at V2 requires | 13 seconds | |
| 242 pulses | | 30 seconds | for correction time. |

The reverse or counterclockwise steps are illustrated in FIG. 4. Initiation of time correction in the counterclockwise direction commences from an initial position of the minute hand 101, first clockwise for 2 pulses at V1 speed to position 105, then in reverse at speed VR1. After moving a preselected number of steps, to a relative position, 106, the minute hand moves at a fast time correcting speed VR2 until it reaches a find position 105. Position 105 is located 30 seconds beyond starting position 101 to compensate for the exact time consumed in the time correcting process, as follows:

| | | | |
|---|---|---|---|
| 2 pulses | at V1 requires | 0.5 sec. | |
| 32 pulses | at VR1 requires | 16.5 sec. | |
| 208 pulses | at VR2 requires | 13.0 sec | |
| 242 | | 30 seconds | for correction time. |

plete revolution for counter clockwise direction, because the hand is moving opposite that of time telling movement. This problem is solved with the present invention by the expedient of moving for a short time in the clockwise direction before reversing, as shown in FIG. 4. This is summarized below.

| CLOCKWISE | COUNTERCLOCKWISE |
|---|---|
| +34 steps - cw - V1 | +2 steps cw - V1 |
| +208 steps - cw - V2 | −2 steps ccw - VR1 |
| | −30 steps ccw - VR1 |
| | −208 steps ccw - VR2 |
| 242 steps net movement. | 238 steps net movement. |

FIG. 5 illustrates accelerated timesetting in the forward direction at a speed V3 which continues until the pushbutton is released, at which time speed reverts to slow speed V1 (Program 7).

Figure 6:
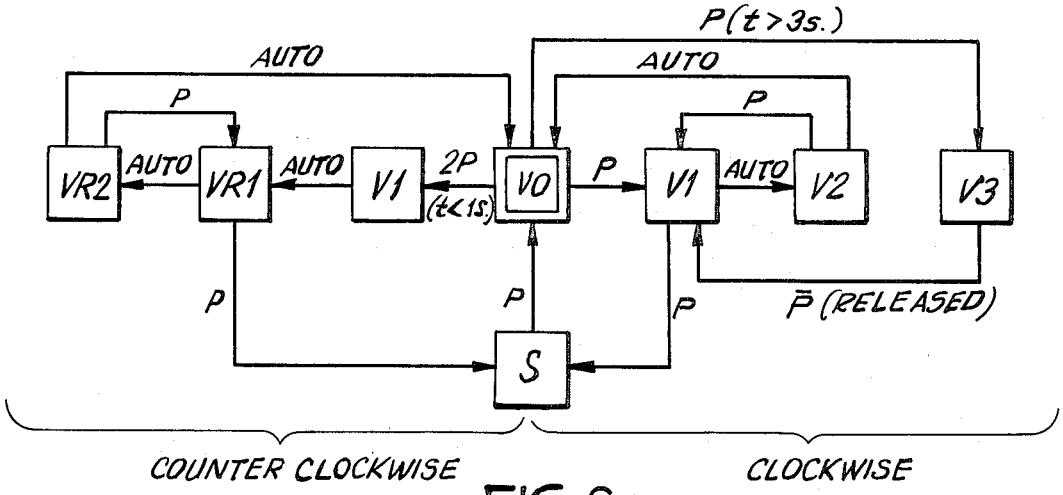

Referring to FIG. 6 of the drawings, the multiple time correcting programs or modes are shown by means of a "state" diagram". The speed states are indicated by the blocks labeled V0, V1, V2, V3 in the clockwise direction, VR1, VR2 in the counterclockwise direction, and S for "stop". Initiation of transition of one state to the next, and the direction of state change, are indicated by symbols between the blocks. P designates momentarily actuation of the pushbutton 9 one time, 2P two times. Where the pushbutton is depressed and held for more than a preselected time period or depressed and released within less than a preselected time period, this is indicated in parentheses by (t>--), (t<--), respectively. Automatic transition from one state to the next is indicated by "AUTO". AUTO designates state changes after a predetermined number of pulses determined by counters K, L, M.

The diagram should be self explanatory when considered in connection with the following Table 3.

TABLE 3

| PROG. NO. | INITIATION OR CONTROL | PROGRAM SEQUENCE | DESCRIPTION |
|---|---|---|---|
| 1 | P | V,V1,V2,V | Forward slow speed, forward fast speed, automatic restart without affecting timekeeping. |
| 2 | 2P(t < 1) | V,V1,VR1,VR2,V | Two steps forward, reverse slow speed, reverse fast speed, automatic restart without affecting timekeeping. |
| 3 | P,P,P | Vo,V1,S,Vo | Forward slow speed, stop, manual start. |
| 4 | P,P,P,P | V,V1,V2,V1,S,V | Forward slow speed, forward fast speed, forward slow speed, stop, manual start |
| 5 | 2P(t < 1),P,P | V,V1,VR1,S,V | Two steps forward, reverse slow speed, stop, manual start. |
| 6 | 2P(t < 1),P,P,P | V,V1,VR1,VR2,VR1, S,V | Two steps forward, reverse slow speed, reverse fast speed, reverse slow speed, stop, manual start. |
| 7 | P(t > 3),P,P,P | V,V3,V1,S,V | Forward accelerated speed, forward slow speed, stop, manual start. |

In accordance with one aspect of the invention, it should be noted that the total number of pulses to the stepping motor, as measured by counters K, L, M is the same in both cases, i.e., 242, regardless of the direction of hand movement. However, the net movement of the hand from start to finish, in order to compensate for correction time, must be more than one complete revolution for clockwise correction and less than one com- For example, program 1 for a single time zone change forward is initiated by a single momentary pushbutton pulse P. The timesetting proceeds at a slow speed V1, then automatically to a fast speed V2, and then automatically restarts normal V0 speed and resets all counters without affecting timekeeping of the watch. Program 5 initiated by two momentary pushes of the pushbutton to cause the minute hand to move (after two steps forward) at slow speed VR1 in the counterclockwise direction. A single momentary push P of the pushbutton during VR1 stops the watch. Another push P restarts the watch and resets the counter 60. This mode of correction is conveniently used when adjusting the time using a time setting standard or reference signal. Other programs can be understood by using Table 3 in conjunction with FIG. 6.

Thus, there has been decribed an improved time correcting electronic circuit useful for a quartz analog stepping motor watch. While there has been described what is considered to be the preferred embodiment of the invention, other modifications will occur to those skilled in the art. It is desired to secure in the appended claims all such modifications as fall within the true spirit and scope of the invention.

I claim:

1. An electronic analog timepiece comprising:

a time standard providing periodic high frequency signals, a frequency divider providing periodic low frequency signals in response to said high frequency signals, said divider also providing first, second, and third intermediate frequency signals, a drive circuit responsive to stepping motor pulses supplied at a plurality of different frequencies and adapted to provide forward pulse wave shapes and reversing pulse wave shapes at selected frequencies, a reversible stepping motor adapted to rotate the hands of said timepiece in response to signals from the drive circuit, and control circuit responsive to said low frequency and to said first, second, and third intermediate frequency signals, said control circuit having first gating means furnishing normal, slow, fast, and accelerated stepping pulses to the drive circuit for movement of said timepiece in at least one direction, said control circuit further including a plurality of counters having a plurality of second gating means connected to selected counter outputs, and a plurality of flip-flop means arranged to control transition from one stepping speed to the next in response to preselected numbers of counts registered by said counters, and a manual time correcting switch connected to said control circuit for controlling said logic switching means.

2. The combination in accordance with claim 1, wherein preselected counts automatically transfer the stepping speed from slow to fast, and back to normal speed after actuation of the said manual switch, said count being such as to correct for one hour adjusted by the time consumed during the time correction.

3. The combination according to claim 1, wherein said control circuit includes second logic switching means responsive to said manual switch adapted to interrupt the slow pulses when the manual switch is actuated a second time and third logic switching means adapted to restart normal pulses when the manual switch is actuated again.

4. The combination according to claim 1, wherein said control circuit includes a fourth device having time delay and switching means responsive to said manual switch, and adapted to provide a reversing signal to said drive circuit in accordance with the number of times the manual switch is actuated within a predetermined time interval.

5. The combination according to claim 1, wherein said control circuit is adapted to provide a plurality of time correcting programs and includes logic switching means responsive to said manual switch providing a first program for automatically incrementing the timepiece by one hour without affecting minute hand setting in response to a first pulse count from said counters, automatically incrementing the timepiece counterclockwise by one hour in response to the same pulse count by the counters, a third program for interrupting the first program and restarting the timepiece in response to actuation of said manual switch, a fourth program for interrupting the second program and restarting the timepiece in response to actuation of the manual switch.

6. The combination according to claim 5, and further including a fifth program responsive to the third intermediate frequency for providing accelerated setting of the timepiece.

7. The combination according to claim 8 wherein said control circuit includes time delay and switching means associated with said manual switch such that a single momentary closure of the switch actuates rotation in one direction and increments the time by one hour in accordance with the pulse count from said counters and wherein momentary closure of the switch more than once within a predetermined time interval initiates time correction of the hands first in said one direction and then in the opposite direction for an increment of one hour in accordance with the same pulse count from said counters, whereby the same number of pulse counts serves to provide time correction and to compensate for time required to make the correction, regardless of the direction of rotation.

8. An electronic analog timepiece comprising:

a time standard providing periodic high frequency signals, a frequency divider connected to the time standard and providing a periodic low frequency signal in response to said high frequency signals, said divider also providing a plurality of trains of periodic intermediate frequency signals.

a drive circuit responsive to stepping pulses at a plurality of frequencies and adapted to provide forward pulse wave shapes and reverse pulse wave shapes, a reversible stepping motor adapted to rotate the hands of said timepiece clockwise or counterclockwise in response to the pulse wave shapes from said drive circuit, and control circuit responsive to said low frequency and said intermediate frequency signals with an output connected to said drive circuit, said control circuit including logic switching means supplying first intermediate frequency signals for time correcting at a slow speed with automatic switching to a second intermediate frequency signal for time correcting at a fast speed after a preselected number of pulses furnished by said divider to said control circuit and wherein said control circuit includes a plurality of counters which count a preselected number of pulses at said first intermediate frequency, and wherein said logic switching means is responsive to a preselected pulse count from said counters actuating a first device which enables stepping pulses to said drive circuit at said second higher intermediate frequency.

9. An electronic analog timepiece comprising:

a time standard providing periodic high frequency signals, a frequency divider connected to the time standard and providing a periodic low frequency signal in response to said high frequency signals, said divider also providing a plurality of trains of periodic intermediate frequency signals, a drive circuit responsive to stepping pulses at a plurality of frequencies and adapted to provide forward pulse wave shapes and reverse pulse wave shapes, a reversible stepping motor adapted to rotate the hands of said timepiece clockwise of counterclockwise in response to the pulse wave shapes from said drive circuit, and a control circuit responsive to said low frequency and said intermediate signals with an output connected to said drive circuit, said control circuit including logic switching means supplying first intermediate frequency signals for time correcting at a slow speed with automatic switching to a second intermediate frequency signal for time correcting at a fast speed after a preselected number of pulses furnished by said divider to said control circuit and wherein said logic switching means includes a second device which is connected to return the timepiece to normal running speed after a second preselected number of pulses at slow and fast time correcting speeds have been counted, said second preselected number of pulses being such as to advance the timepiece hands by one hour adjusted by the time consumed and the time taken to carry out the slow and fast time correcting speeds.

10. An electronic analog timepiece comprising:

a time standard providing periodic high frequency signals, a frequency divider connected to the time standard and providing a periodic low frequency signal in response to said high frequency signals, said divider also providing first, second, and third intermediate frequencies signals of successively higher frequencies, a drive circuit responsive to stepping pulses at a plurality of frequencies and adapted to provide forward pulse wave shapes and reverse pulse wave shapes, a reversible stepping motor adapted to rotate the hands of said timepiece, clockwise or counterclockwise, in response to the pulse wave shapes from said drive circuit, a control circuit responsive to said low frequency and said intermediate frequency signals with an output connected to said drive circuit for providing said drive circuit with normal, slow, and fast stepping pulses to rotate said hands in at least one direction, said control circuit including logic switching means supplying first intermediate frequency signals for time correcting at a slow speed with automatic switching to a second intermediate signal for time correcting at a fast speed after a preselected number of pulses furnished by said divider to said control circuit and wherein said logic switching means is adapted to supply slow, fast, and accelerated time correction pulses to said drive circuit for producing timepiece movement in at least one direction corresponding to the first, second, and third intermediate frequencies, and a manual switch connected to said control circuit for transmitting said third intermediate frequency to said drive circuit when said manual switch is closed for more than a predetermined period of time.

11. An electronic analog timepiece comprising:

a time standard providing periodic high frequency signals, a frequency divider connected to the time standard and providing periodic low frequency signals in response to said high frequency signals, said divider also providing a plurality of trains of periodic intermediate frequency signals, a drive circuit responsive to stepping pulses at a plurality of frequencies and adapted to provide forward pulse wave shapes and reverse pulse wave shapes, a reversible stepping motor adapted to rotate the hands of said timepiece, clockwise or counterclockwise, in response to the pulse wave shapes from said drive circuit, a control circuit connected to said time correcting switch and responsive to said low frequency and said intermediate frequency signals with an output connected to said drive circuit, said control circuit including logic switching means supplying first intermediate frequency signals for time correcting at a slow speed with automatic switching to a second intermediate frequency signal for time correcting at a fast speed after a preselected number of pulses furnished by said divider to said control circuit, and a manual time correcting switch connected to said control circuit for controlling said logic switching means which control circuit is adapted to interrupt either the slow or fast stepping pulses to the drive circuit when said manual switch is actuated for a second time after time correcting has commenced.

12. The combination according to claim 1, including third logic switching means adapted to restart the normal stepping pulses to the drive circuit when the manual switch is actuated again.

* * * * *